US008023873B2

(12) United States Patent
Nakatsu

(10) Patent No.: US 8,023,873 B2
(45) Date of Patent: Sep. 20, 2011

(54) IMAGE FORMING APPARATUS

(75) Inventor: Haruhiko Nakatsu, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 684 days.

(21) Appl. No.: 12/116,826

(22) Filed: May 7, 2008

(65) Prior Publication Data

US 2008/0279572 A1 Nov. 13, 2008

(30) Foreign Application Priority Data

May 11, 2007 (JP) ..... 2007-126628

(51) Int. Cl.
*G03G 15/04* (2006.01)
*G03G 21/14* (2006.01)

(52) U.S. Cl. ..... 399/302; 399/297

(58) Field of Classification Search ..... 399/130, 399/159–165, 177, 178, 179, 297–303, 306; 347/116; *G03G 15/04, 15/14, 21/14*
See application file for complete search history.

(56) References Cited

U.S. PATENT DOCUMENTS 5,905,519 A * 5/1999 Brenner et al. ..... 347/116
2008/0088691 A1* 4/2008 Fitzpatrick et al. ..... 347/116

FOREIGN PATENT DOCUMENTS

JP 62169179 A * 7/1987
JP 11223973 A * 8/1999
JP 2000147976 A * 5/2000
JP 2000158703 A * 6/2000
JP 2004069800 A * 3/2004
JP 2005-338111 12/2005

* cited by examiner

*Primary Examiner* — Judy Nguyen
*Assistant Examiner* — Nguyen Q Ha
(74) *Attorney, Agent, or Firm* — Canon U.S.A., Inc., IP Division

(57) ABSTRACT

A scanning start timing for an optical scanning unit is adjusted according to detection values of belt position detecting units arranged upstream and downstream from a primary transfer position in a movement direction of an endless type belt to thereby transfer an image onto a proper position without being affected by one-sided or meandering travel of an intermediate transfer belt or the endless type belt that serves as a transfer material conveying unit.

2 Claims, 10 Drawing Sheets

FIG. 8

| | | | | | | | | |
|---|---|---|---|---|---|---|---|---|
| ONE-SIDED MOVEMENT DIRECTION DETERMINATION SIGNAL | | + | + | + | ·· | − | − | − |
| POSITIONAL INFORMATION OF BELT IN MAIN SCANNING DIRECTION | FIRST TIME | Xa(1,1) | Xa(1,2) | Xa(1,3) | ·· | Xa(1,n-2) | Xa(1,n-1) | Xa(1,n) |
| | SECOND TIME | Xa(2,1) | Xa(2,2) | Xa(2,3) | ·· | Xa(2,n-2) | Xa(2,n-1) | Xa(2,n) |
| | THIRD TIME | Xa(3,1) | Xa(3,2) | Xa(3,3) | ·· | Xa(3,n-2) | Xa(3,n-1) | Xa(3,n) |
| | ·<br>· | ·<br>· | ·<br>· | ·<br>· | ·<br>· | ·<br>· | ·<br>· | ·<br>· |
| | (m-1)-TH TIME | Xa(m-1,1) | Xa(m-1,2) | Xa(m-1,3) | ·· | Xa(m-1,n-2) | Xa(m-1,n-1) | Xa(m-1,n) |
| | m-TH TIME | Xa(m,1) | Xa(m,2) | Xa(m,3) | ·· | Xa(m,n-2) | Xa(m,n-1) | Xa(m,n) |
| | AVERAGE | $\sum_{M=1}^{m} Xa(M,1)/m$ | $\sum_{M=1}^{m} Xa(M,2)/m$ | $\sum_{M=1}^{m} Xa(M,3)/m$ | ·· | $\sum_{M=1}^{m} Xa(M,n-2)/m$ | $\sum_{M=1}^{m} Xa(M,n-1)/m$ | $\sum_{M=1}^{m} Xa(M,n)/m$ |

ONE PERIOD

IMAGE FORMING APPARATUS

BACKGROUND OF THE INVENTION

1. Field of the Invention

The present invention relates to an image forming apparatus including at least one image carrier, and an endless transfer belt for carrying an image or conveying a transfer material.

2. Description of the Related Art

Hitherto, a direct transfer method and an intermediate transfer method have been employed as a method for transferring toner images from a photosensitive member to a transfer material in an image forming apparatus that scans an electrophotographic photosensitive member with a laser beam that is modulated based on image information, for example.

According to the direct transfer method, a belt-like unit for conveying a transfer member conveys a transfer material through a transfer position to directly transfer toner images from a photosensitive member to the transfer material. The intermediate transfer method primarily transfers toner images on a photosensitive member onto a belt-like intermediate transfer member at a primary transfer position, and transfers the primary transfer images onto a transfer material at a secondary transfer position.

The endless transfer belt used as a transfer material conveying member or an intermediate transfer member in the image forming apparatus is stretched over a plurality of rollers and rotated in a predetermined direction (sub-scanning direction). However, a so-called one-sided travel sometimes occurs due to non-parallel movements of the plurality of rollers or variations in outer diameter among the rollers. In that case, the endless transfer belt moves while deviating from its normal direction in an axial direction of the roller (main-scanning direction, i.e., exposure-scanning direction), which is orthogonal to the moving direction.

The one-sided travel causes a phenomenon that the belt moves in the main scanning direction and toner images are not transferred onto a proper position on the transfer material. The phenomenon is called margin deviation. Further, in an inline-type color image forming apparatus in which an endless transfer belt circulates through a plurality of transfer positions to superimpose toner images on one another, a color drift may occur due to the one-sided travel. The color drift is a phenomenon that transferred toner images are misaligned in a main scanning direction.

To address the above problem, Japanese Patent Application Laid-Open No. 2005-338111 discusses a method for changing a timing at which an optical scanning unit starts scanning a photosensitive member in a main scanning direction based on positional information of an endless belt in the main scanning direction. Thus, positions of toner images on the photosensitive member can be adjusted in the main scanning direction according to a position of the belt in the main scanning direction.

In general, the endless transfer belt does not deviate from its original course to a main scanning direction while moving in parallel to the sub-scanning direction, but the transfer belt is slightly skewed in a sub-scanning direction when the deviation occurs. Moreover, the belt is mechanically and electrostatically sandwiched between a photosensitive member and a transfer unit at a transfer position, so that an inclination angle of the belt to the sub-scanning direction might vary between an upstream side and a downstream side from the transfer position.

Thus, in such an image forming system which adjusts a timing to start scanning in a main scanning direction based on positional information of an endless transfer belt in a main scanning direction, if the scanning start timing is adjusted only based on positional information of the belt on an upstream side from a transfer position, it is difficult to adjust positional deviation of the belt in the main scanning direction. For example, a difference between a main scanning direction of the belt at a sensor detection position that is apart from a transfer position and a main scanning direction of the belt at the transfer position directly leads to a color drift.

SUMMARY OF THE INVENTION

The present invention is directed to an image forming apparatus capable of more accurately adjusting a scanning start timing corresponding to positional deviation of an endless transfer belt serving as an intermediate transfer member or a transfer material conveying unit from a main scanning direction at a transfer position due to one-sided travel of the belt.

According to an aspect of the present invention, an image forming apparatus, includes an image carrier, an optical scanning unit configured to scan the image carrier with light to form latent images, a developing unit configured to develop latent images formed by the optical scanning unit into toner images, an endless transfer belt onto which the toner images formed on the image carrier are transferred at a predetermined transfer position, a first position detecting unit configured to detect a main-scanning-direction position of the endless transfer belt at a first position downstream from the transfer position in a movement direction of the endless transfer belt, a second position detecting unit configured to detect a main-scanning-direction position of the endless transfer belt at a second position upstream from the transfer position in a movement direction of the endless transfer belt, and a control unit configured to determine a scanning start position at which the optical scanning unit starts scanning the image carrier in the main scanning direction based on a main-scanning-direction position of the endless transfer belt detected by the first position detecting unit, and a main-scanning-direction position of the endless transfer belt detected by the second position detecting unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 8 is a graph illustrating data stored in a storage unit.

DETAILED DESCRIPTION OF THE EMBODIMENTS

Various exemplary embodiments, features, and aspects of the invention will be described in detail below with reference to the drawings.

First Exemplary Embodiment

Figure 1:
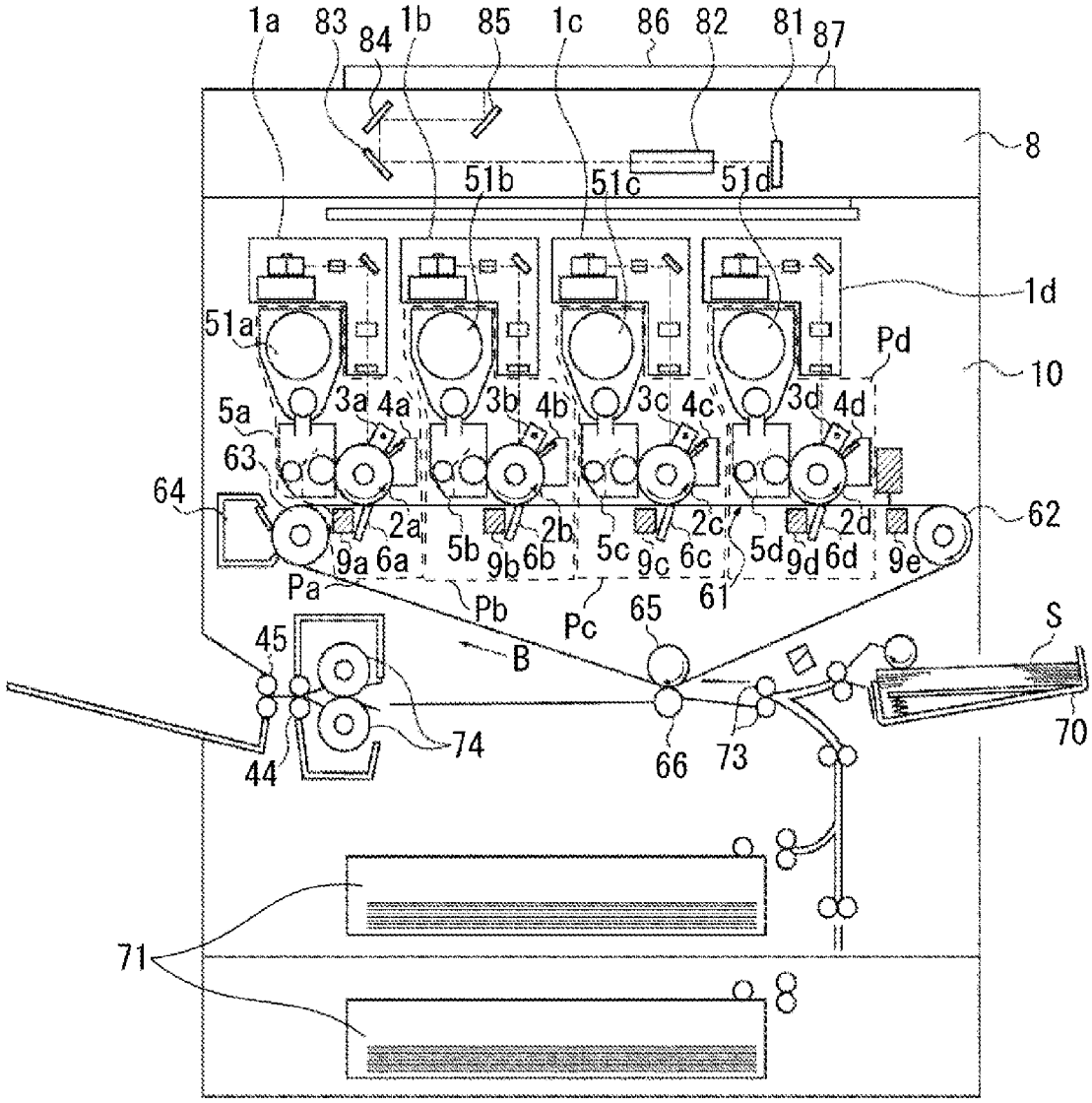
FIG. 1 is a sectional view of an image forming apparatus according to an exemplary embodiment of the present invention.

FIG. 1 is a sectional view illustrating a configuration of an inline-type digital full-color image forming apparatus according to an exemplary embodiment of the present invention. The image forming apparatus includes a document reading unit 8 and an image forming unit 10. In the document reading unit 8, a line sensor 81 reads an image of a document that is set on a document positioning plate 87 and fixed by a pressing plate 86 through mirrors 85, 84, and 83 and a scanning lens 82.

The line sensor 81 outputs a signal according to the read data value. Optical scanning units 1*a* to 1*d* in the image forming unit 10 modulate laser light to form an image based on the signal from the line sensor 81. The image forming unit 10 includes four image forming stations Pa to Pd that form developer images of different colors to be transferred to a transfer material. The image forming stations Pa to Pd include cylindrical photosensitive drums 2*a* to 2*d* which are covered with a photosensitive layer as an image carrier.

Further, around the photosensitive drums 2*a* to 2*d*, charging units 3*a* to 3*d* for charging the exposure surface of each photosensitive drum, the optical scanning units 1*a* to 1*d* for applying laser light corresponding to image information of each color to an exposure position of each photosensitive drum (photosensitive member surface) to form latent images, developing units 5*a* to 5*d* for developing the latent images with a developer (toner) into visible images at a development position, transfer units 6*a* to 6*d* for primarily transferring the visible images onto an intermediate transfer belt 61 at a transfer position, and drum cleaning units 4*a* to 4*d* for removing developer remaining on the photosensitive drum surface after a transfer process are arranged in a rotational direction of each drum.

The image forming stations Pa to Pd are integrated into a process cartridge and detachably attached to an apparatus main body. Further, developer containers 51*a* to 51*d* corresponding to the developing units 5*a* to 5*d* are detachably attached to the developing units 5*a* to 5*d* in the form of developer cartridge, and a user can easily replenish developer. The image forming stations Pa, Pb, Pc, and Pd are image forming units for forming a cyan image, a magenta image, a yellow image, and a black image, respectively.

The endless intermediate transfer belt 61 is provided under the photosensitive drums 2*a* to 2*d* and passes through primary transfer positions of the image forming stations Pa to Pd. The surface of the intermediate transfer belt 61, which passes through each of the image forming station Pa to Pd, is stretched between a driving roller 63 and a driven roller 62 so as to configure a substantially flat surface and implement equal transfer conditions (nip pressure) at each transfer position.

In this exemplary embodiment, the intermediate transfer belt 61 is stretched by the driving roller 63, the driven roller 62, and a driven roller 65, and driven by the driving roller 63 in a direction of an arrow B that is a sub-scanning direction. A cleaning unit 64 removes a developer remaining on the intermediate transfer belt 61 after secondary transfer onto the transfer material. The driven roller 62 is a one-sided movement correction roller that adjusts a position of the intermediate transfer belt 61 in a roller shaft direction (main scanning direction).

In the context of this specification, the main scanning direction refers to a direction in which optical scanning units 1*a* to 1*d* scan the surfaces of the photosensitive drums 2*a* to 2*d* with a laser beam. This direction corresponds to an axial direction (generating-line direction) of the photosensitive drums 2*a* to 2*d*. The sub-scanning direction refers to a direction orthogonal to the beam scanning direction, which is a rotational direction of the photosensitive drums 2*a* to 2*d* or a movement direction of the intermediate transfer belt 61.

In the above-described configuration, first a cyan latent image is formed on the photosensitive drum 2*a* by the charging unit 3*a* of the first image forming station Pa, process units such as the optical scanning unit 1*a*, and a scanning start position control mechanism (as described later) so as to transfer the image to a proper position in primary transfer. The developing unit 5*a* develops the latent image with a developer including cyan toner, into a visible image as a cyan toner image, and the transfer unit 6*a* transfers the cyan toner image onto the surface of the intermediate transfer belt 61.

On the other hand, while the above-described cyan toner image is transferred to the intermediate transfer belt 61 at a transfer position, a magenta latent image is formed at an exposure position of the photosensitive drum 2*b* in the second image forming station Pb. Subsequently, the developing unit 5*b* develops the latent image with magenta toner into a toner image at a development position of the photosensitive drum 2*b*. The transfer unit 6*b* transfers the magenta toner image onto the cyan image on the intermediate transfer belt 61 to which the cyan toner image has been transferred in the first image forming station Pa.

Then, a yellow image and a black image are formed in a similar manner. After the completion of forming toner images of four colors on the intermediate transfer belt 61, the toner images of four colors on the intermediate transfer belt 61 are conveyed to a secondary transfer position. At the secondary transfer position, a transfer roller 66 transfers the toner images from the intermediate transfer belt 61 onto a sheet material S. The sheet material S is a transfer material fed from a manual sheet feeding unit 70 or a main-body sheet feeding unit 71 after performing registration with a registration roller 73.

The sheet material subjected to the secondary transfer is conveyed up to a fixing roller pair 74, and the toner images on the surface are fixed under heating. Then, the sheet material S is discharged from the apparatus by a discharge roller pair 44 and 45. Next, a position detecting mechanism used for adjusting a scanning start position in the main scanning direction is described. This mechanism detects an edge position on one side of the intermediate transfer belt 61 in the main scanning direction.

In order to detect main-scanning-direction position (scanning-direction position) of one side edge portion of the intermediate transfer belt 61, first position detecting units 9*b* to 9*e* are provided to detect a first position disposed downstream from each primary transfer position in a movement direction of the intermediate transfer belt 61 (see FIG. 1). Further, second position detecting units 9*a* to 9*d* are provided for detecting a second position in each photosensitive drum, which is disposed upstream from each primary transfer position in the movement direction of the intermediate transfer belt 61 (see FIG. 1).

For example, the first position in the drum 2*d* is detected by the first position detecting unit 9*e* and the second position is detected by the second position detecting unit 9*d*. Further, the first position of the drum 2*c* is detected by the first position detecting unit 9*d* and the second position is detected by the second position detecting unit 9*c*.

Figure 3:
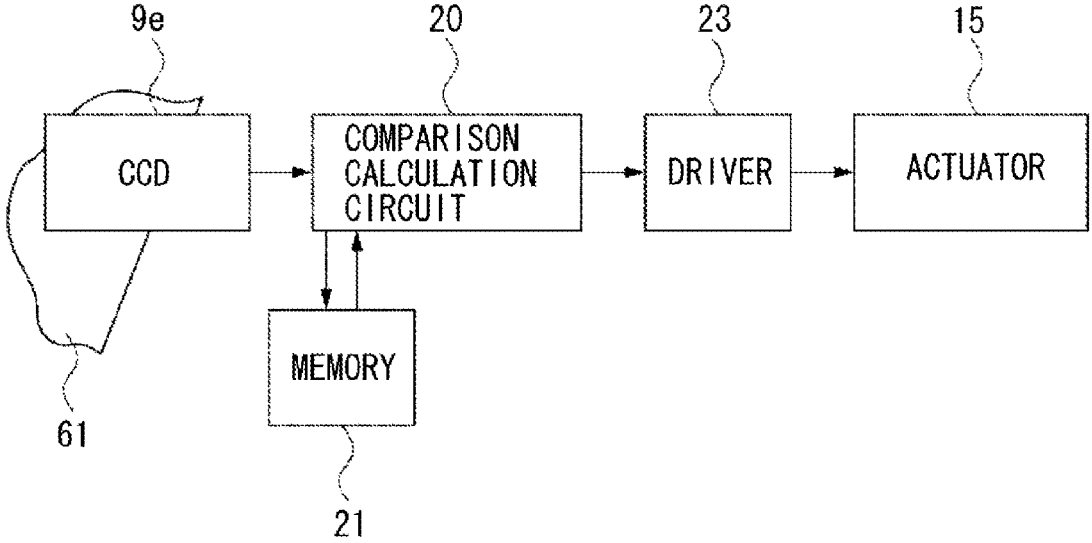
FIG. 3 is a block diagram illustrating a mechanism for controlling one-sided travel of an intermediate transfer belt according to an exemplary embodiment of the present invention.

In this example, the first and second position detecting units include charge coupled devices (CCDs) as illustrated in FIG. 3, and detect a main-scanning-direction position of one side edge portion of the intermediate transfer belt 61 based on a luminance signal. However, any position other than the edge position may be detected insofar as a main-scanning-direction position of the belt can be determined. For example, a marker position on the intermediate transfer belt 61 may be detected by a sensor to determine a main-scanning-direction position of the intermediate transfer belt 61.

Next, an operation for controlling one-sided movement of the endless type belt employed in this exemplary embodiment is described. An inclined angle of at least one of the plurality of rollers for stretching the endless belt (hereinafter referred to as "one-sided movement correction roller") is controlled to adjust the intermediate transfer belt 61 toward the main scanning direction. Further, both edge positions of the intermediate transfer belt 61 in a to-and-fro direction are determined, and the intermediate transfer belt 61 is periodically moved to and fro in the main scanning direction to prevent the intermediate transfer belt 61 from being damaged due to one-sided travel in the main scanning direction.

Figure 2:
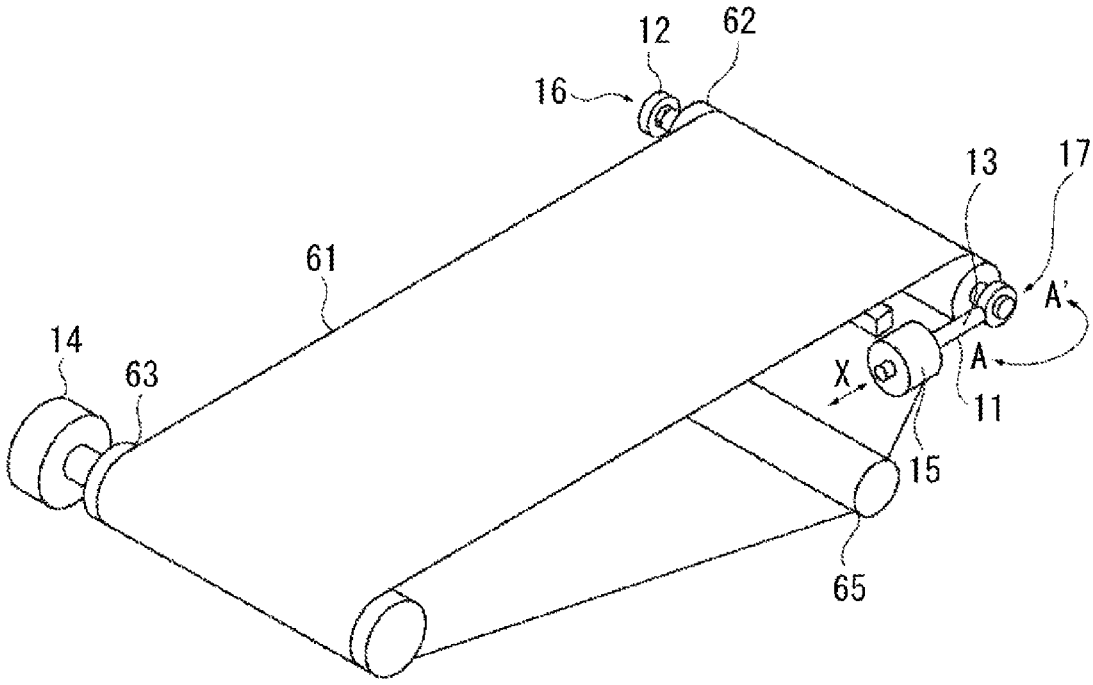
FIG. 2 is a perspective view of an intermediate transfer belt according to an exemplary embodiment of the present invention.

For ease of explanation, one side of the intermediate transfer belt 61 where the scanning starts is referred to as "front side" and the other side of the belt where the scanning ends is referred to as "back side". The intermediate transfer belt 61 continues the periodical to-and-fro motion at least while the photosensitive member is rotating and a memory is storing a belt position history as described below. Referring to FIG. 2, the configuration for controlling one-sided travel of the intermediate transfer belt 61 in the main scanning direction is described.

The rollers 62, 63, and 65 that stretch the intermediate transfer belt 61 are rotatably supported, and the pivot of the driving roller 63 is connected to a driving motor 14 for moving the intermediate transfer belt in the sub-scanning direction. The one-sided movement correction roller 62 controls one-sided travel of the intermediate transfer belt. The pivot of the one-sided movement correction roller 62 is supported by a pivot bearing 12 at one end (hereinafter referred to as a pivot end 16) and is supported by a bearing 13 at the other end (hereinafter referred to as a control end 17).

The bearing 13 is connected to a rod 11 that is coupled with an operating shaft of an actuator 15 serving as an adjustable unit. The operating shaft of the actuator 15 reciprocates along the movement direction of the intermediate transfer belt 61 as indicated by the arrow X, so that the control end 17 is moved slightly in an arc shape as indicated by the line A-A' of FIG. 2 together with the one-sided movement correction roller 62 through the rod 11.

In other words, the one-sided movement correction roller 62 oscillates owing to the movement of the control end 17 around the pivot end 16. In this exemplary embodiment, the actuator 15 is a stepping motor. A driver 23 (see FIG. 3) applies a predetermined drive signal (pulse signal) to the stepping motor, so that the control end 17 alternatively moves toward the back side and the front side at a predetermined speed to allow the belt to periodically move to and fro in the main scanning direction.

Figure 4:
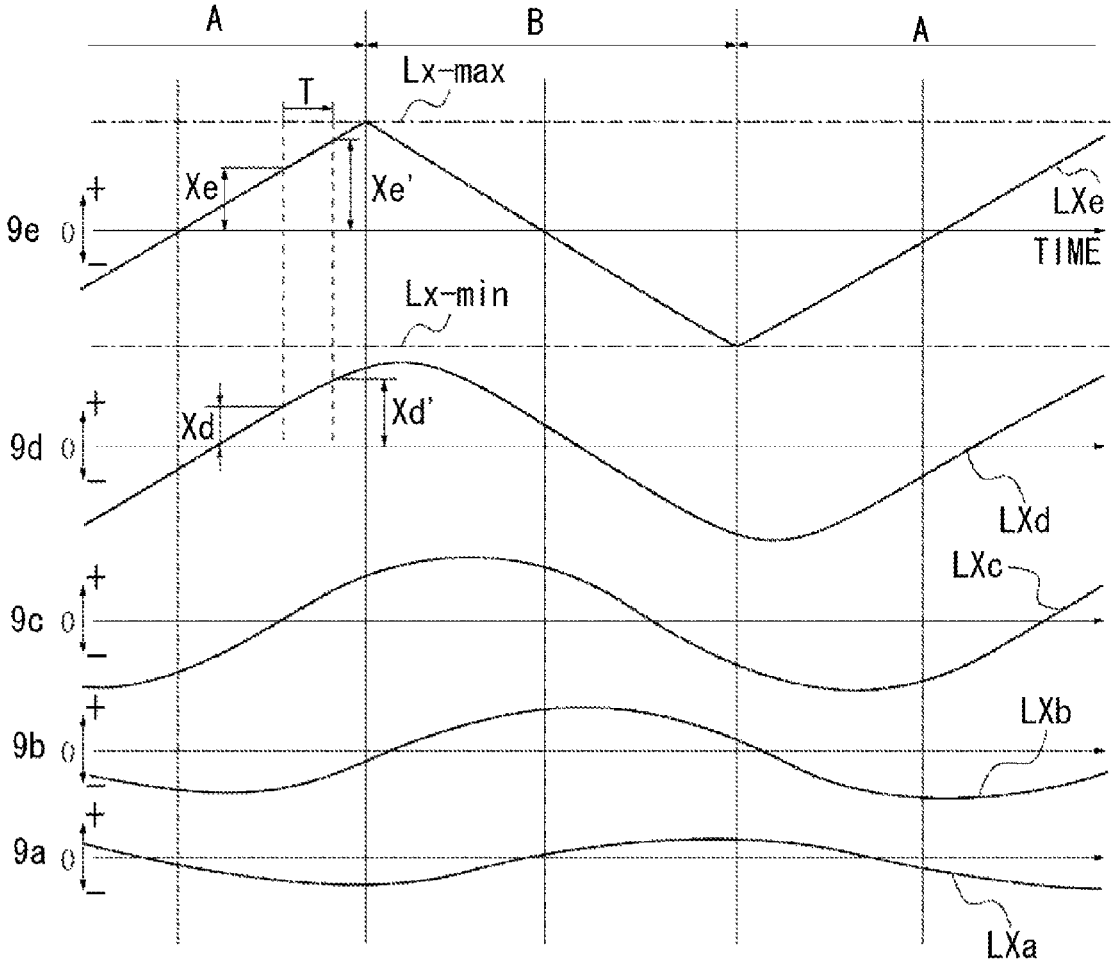
FIG. 4 is a graph illustrating position history of one side edge of an intermediate transfer belt edge detected by a position detecting unit.

Referring to FIGS. 3 and 4, a one-sided travel behavior of the intermediate transfer belt 61 is described. FIG. 3 is a schematic diagram illustrating one-sided travel controlling circuit and mechanism. FIG. 4 illustrates a relationship between an elapsed time and detection values obtained by the detection units 9*a* to 9*e* which are stored in the memory 24 (storage unit) of FIG. 6. In FIG. 4, history charts LXa to LXe of a main-scanning-direction position of one side edge of the belt in each detection position are illustrated.

The horizontal axis represents a time, and the vertical axis represents a position of one side edge of the belt relative to a reference position 0 (the center of a distance between both edge positions in a to-and-fro movement range of one side edge of the belt in the main scanning direction), which is detected by each of the belt position detecting units 9*a* to 9*e*. Here, a position on the back side of the image forming apparatus is represented by + and a position on the front side thereof is represented by –.

The position detecting unit (9*e* in this exemplary embodiment) which is closest to the one-sided movement correction roller 62 on the belt between the stationary roller 63 and the one-sided movement correction roller 62 is also used for controlling the one-sided travel of the intermediate transfer belt 61 with the actuator 15 (see FIG. 3).

The memory 21 prestores information about the maximum one-sided position that is the backmost position in the to-and-fro direction (the maximum value LX-max of the position history chart LXe of the position detected by the position detecting unit 9*e* in FIG. 4) and the maximum one-sided position that is the frontmost position in the to-and-fro direction (the minimum value LX-min of the position history chart LXe).

When the driver 23 drives the actuator 15 using an forward drive signal to move the control end 17 toward the back side at a predetermined speed (see FIG. 3), a detection value of the first position detecting unit 9*e* increases in a + direction as indicated by a portion A of FIG. 4.

During the movement of the belt, a comparator circuit 20 reads the maximum one-sided position (in a back side direction) information LX-max from the memory 21 to compare the read value with the belt main-scanning-direction position Xe detected by the first belt position detecting unit 9*e*. If the read value matches the detected position, the driver 23 supplies a homeward drive signal to the actuator 15. Then, one side edge of the one-sided movement correction roller 62 (on the bearing 13 side) starts moving toward the front side.

The intermediate transfer belt 61 starts moving in a reverse direction toward the front side of the image forming apparatus, and a detection value of the first position detecting unit 9*e* decreases in a – direction as indicated by a portion B in FIG. 4. Then, when a detection value of the detection unit 9*e* matches the maximum one-sided position (in a front side direction) LX-min, the outward drive signal is supplied to the actuator 15. In this way, the intermediate transfer belt 61 periodically moves to and fro in the main scanning direction within a predetermined range.

The intermediate transfer belt 61 is mechanically and electrostatically sandwiched between each photosensitive drum and the transfer unit. Hence, in the illustrated apparatus where the first position is closer to the one-sided movement correction roller 62 than the second position in each photosensitive drum, a main-scanning-direction position of one side edge of the belt at the second position is moved with a delay compared with a main-scanning-direction position of one side edge of the belt at the first position (see FIG. 4).

Further, the intermediate transfer belt 61 is moved around a contact portion with the driving roller 63 in the main scanning direction. Thus, as illustrated in FIG. 4, the closer the intermediate transfer belt 61 comes to the driving roller 63 (i.e., farther away from the one-sided movement correction roller 62), the smaller the displacement in the main scanning direction becomes.

Figure 5:
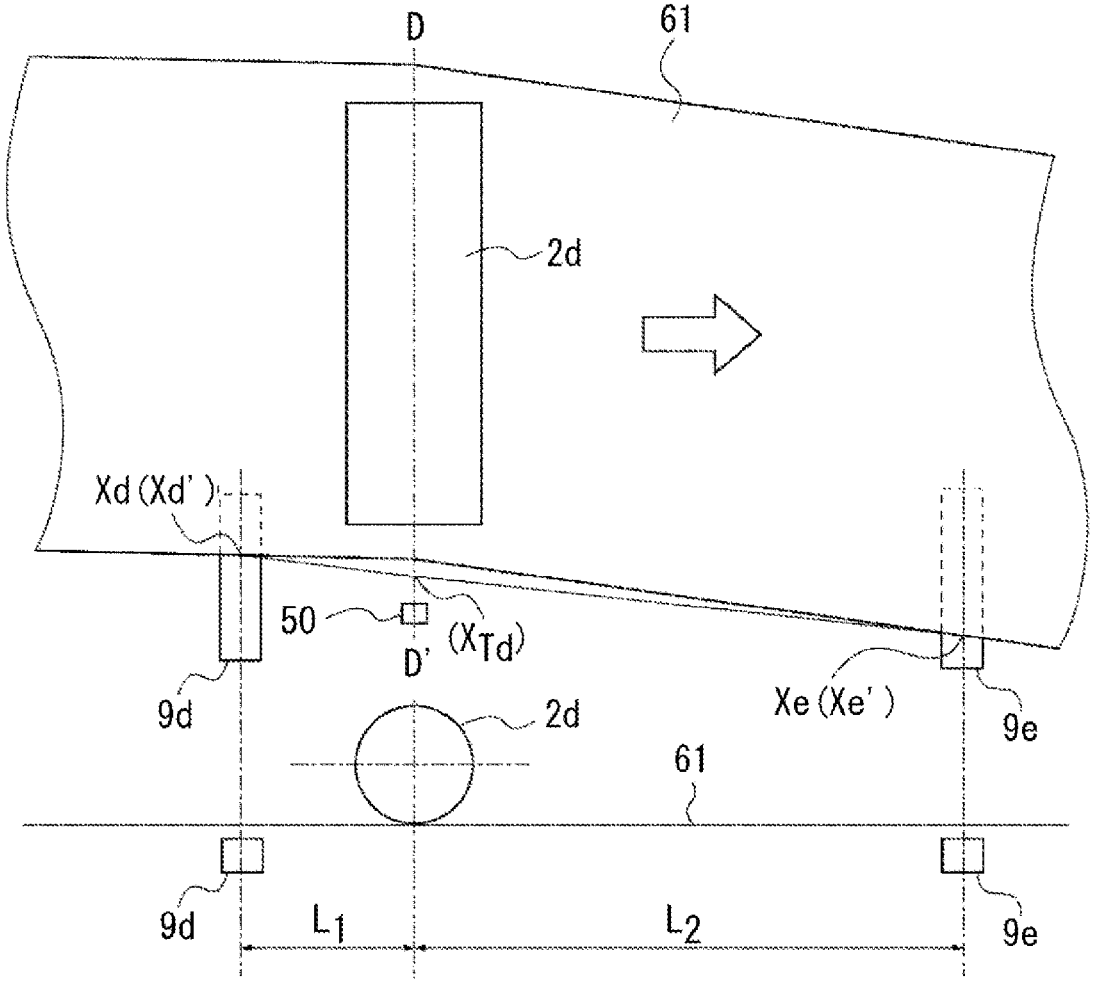
FIG. 5 is a top/side view illustrating a transfer position of a photosensitive drum and its vicinities.
Figure 6:
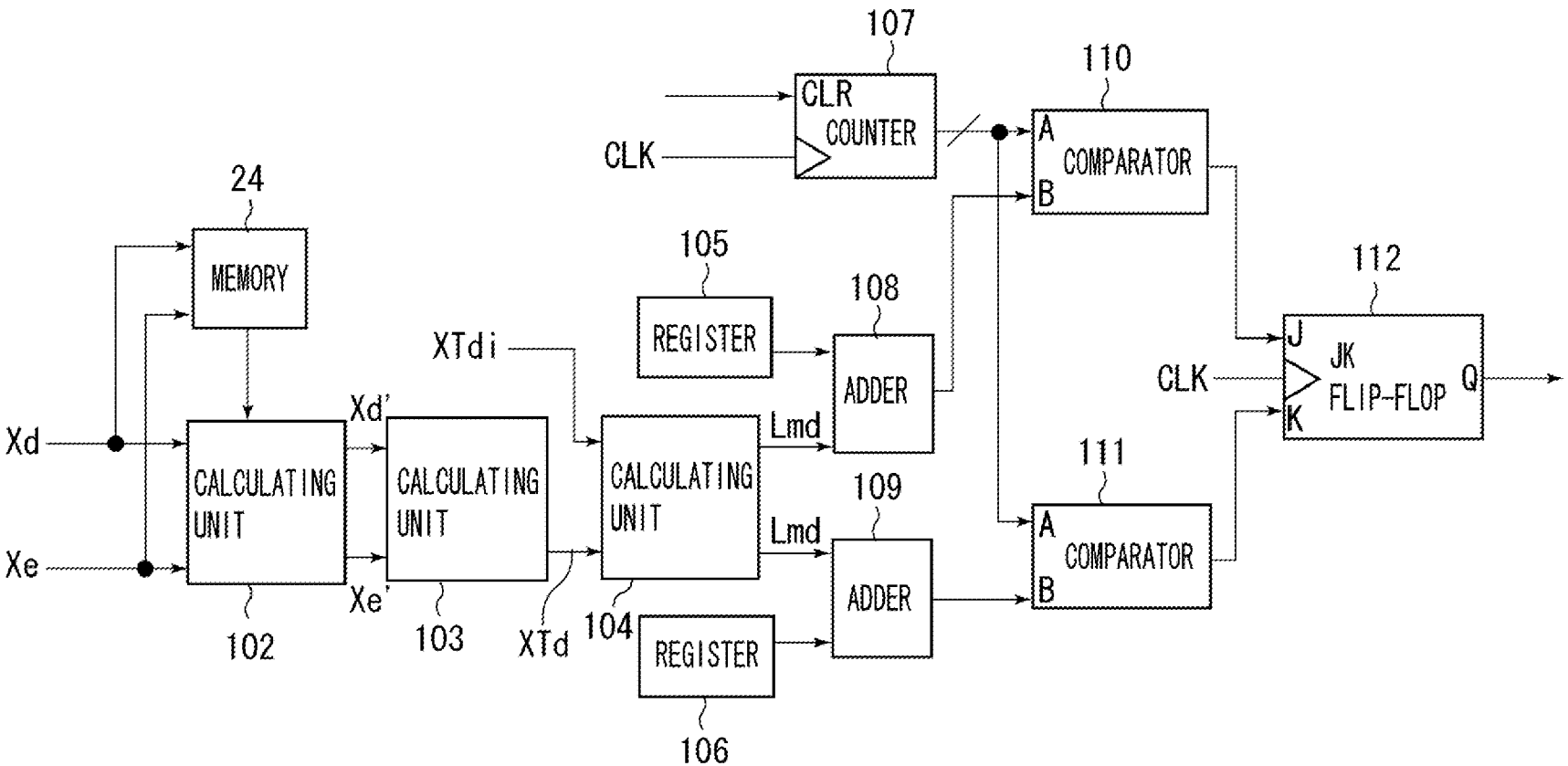
FIG. 6 is a block diagram illustrating a mechanism for controlling a scanning start timing.

Next, a calculation unit for determining a main-scanning-direction position of the intermediate transfer belt 61 at the start of primary transfer (when the top of one page of an image in a sub-scanning direction, which is formed on the photosensitive drum through scanning with a laser beam modulated according to a recorded image signal, reaches the first transfer position) is described (see FIGS. 5 and 6).

FIG. 5 illustrates a positional relationship among the photosensitive drum 2*d*, the first position detecting unit 9*e*, and the second position detecting unit 9*d* as one example. The upper portion of FIG. 5 illustrates a view seen in a direction vertical to the belt surface (the photosensitive drum side), and the lower portion of FIG. 5 illustrates a view seen in a generating line direction of the photosensitive drum.

In FIG. 5, the line D-D' drawn in the main scanning direction corresponds to the first transfer position as a contact line and its extension on the assumption that the photosensitive drum 2*d* comes into line contact with the intermediate transfer belt 61 flatly stretched at this position. Referring to FIG. 6, control of a scanning timing is described in detail. In FIG. 6, clock signals (sync signal) used in this exemplary embodiment are all pixel clock signals supplied in sync with a recording image signal for modulating a laser beam per pixel.

Control of a scanning start position of the photosensitive drum 2*d* is described below. When a laser oscillator (not illustrated) of the optical scanning unit 1*d* starts scanning, a beam is first incident on the beam detector 50 fixed near a portion of the photosensitive drum from which scanning starts and a counter 107 is reset. At the same time, the reset counter 107 starts counting a number of pixel clocks (CLK in FIG. 6) that are sync signals per pixel.

On the other hand, the sensors 9*e* and 9*d* detect main-scanning-direction positions Xe and Xd at one side edge of the intermediate transfer belt 61, respectively. At the same time, the calculation unit 102 reads, from the memory 24 (storage unit), main-scanning-direction position history information about one side edge of the belt corresponding to one period (main-scanning-directional displacement information) LXe and LXd (see FIG. 4).

Then, the calculation unit 102 determines predicted main-scanning-direction positions Xd' and Xe' at one side edge of the intermediate transfer belt 61 at the first and second positions on the history charts LXe and LXd after the elapse of time T which is required to start primary transfer after the detection is made, based on the positions on the history charts LXe and LXd. The positions on the LXe and LXd correspond to the detected positions Xe and Xd of one side edge of the intermediate transfer belt. The determined positions Xd' and Xe' are output to the calculation unit 103.

Next, the calculation unit 103 determines and outputs a main-scanning-direction approximate position $X_{Td}$ at one side edge of the belt (crossing point between the line connecting the positions Xe' and Xd' and line D-D' corresponding to the transfer position) based on the following expression.

$$X_{Td} = \frac{L1 \cdot Xe' + L2 \cdot Xd'}{L1 + L2}$$

In this expression, L1 represents a distance from the transfer position to the second position (sensor 9*d*), and L2 represents a distance from the transfer position to the first position (sensor 9*e*) (see FIG. 5). In FIG. 5, the detected main-scanning-direction positions Xe and Xd coincide with the predicted positions Xe' and Xd' for illustrative purposes. The parenthesized predicted positions Xe' and Xd', and approximate position $X_{Td}$ are obtained when T elapses after the detection of the positions Xe and Xd.

As described above, an inclined angle of the belt to the sub-scanning direction slightly differs in positions upstream and downstream from the transfer position, so that the approximate position $X_{Td}$ slightly deviates from an actual position of one edge of the belt on the line corresponding to the transfer position at the time, but the displacement is negligible.

The calculation unit 104 calculates a number of delay clocks Lmd from a main-scanning-direction reference position $X_{Tdi}$ of one edge of the belt (scanning start reference position) (at print resolution of 600 dpi, $Lmd=(X_{Td}-X_{Tdi})/(42.3\times10^{-3})$) based on displacement of the main-scanning-direction approximate position $X_{Td}$ of one edge of the belt from the reference position $X_{Tdi}$. Then, the calculation unit 104 outputs the number of delay clocks Lmd to adders 108 and 109.

A register 105 stores the number of pixel clocks from the beam detector to the starting point of a scannable area. The number of pixel clocks is determined based on a main-scanning-direction position at one edge of the transfer material conveyance locus. The adder 108 adds the number of delay clocks Lmd output from the calculation unit 104 and the number of clocks up to the starting point stored in the register 105, and sends the added value to a comparator 110.

The comparator 110 compares the number of clocks counted by the counter 107 with the number of delay clocks Lmd output from the adder 108. If both numbers match, the comparator outputs a write signal for writing an image to a J terminal of a JK flip-flop 112. In response to the input signal from the comparator 110, the JK flip-flop 112 continuously outputs the input write signal for writing an image to the optical scanning unit 1*d*.

In this way, the exposure start timing is adjusted to control the scanning start position on the drum. As a result, even if the belt is moved away from a reference position, start positions of image formation can be aligned to a same position on the belt relative to one another. On the other hand, in a register 106, the total sum of the number of clocks stored in the register 105 and the number of clocks corresponding to an image width is set. The adder 109 adds the set value in the register 206 and the number of delay clocks Lmd to output the addition result to the comparator 111.

The comparator 111 compares the number of clocks counted by the counter 107 with the number of delay clocks Lmd output from the adder 109. If both numbers match, the comparator outputs a signal to stop writing an image signal to a K terminal of the JK flip-flop 112. In response to the input signal from the comparator 111, the JK flip-flop 112 continuously outputs the stop signal from the K terminal to the optical scanning unit 1*d*.

Through the above processing, the optical scanning unit 1*d* is controlled to adjust a timing at which the optical scanning unit 1*d* starts scanning the photosensitive drum 2*d* in the main scanning direction such that an image is transferred to a proper position on the intermediate transfer belt 61. The scanning timing is adjusted each time a predetermined number of scanning operations are performed by the optical scanning unit or each time a predetermined number of transfer materials are transferred. Thus, a scanning start timing for each scanning line is changed.

Control of a scanning start timing for the photosensitive drum 2*d* is as described above. As for the other drums, similarly, a scanning start timing is controlled based on signals of corresponding first and second position detecting units. In this way, toner images of each color can be superimposed and transferred with no color drift. Next, referring to FIGS. 7 and 8, a flow for storing the history of the main-scanning-direction position of the belt in the memory 24 is described.

Figure 7:
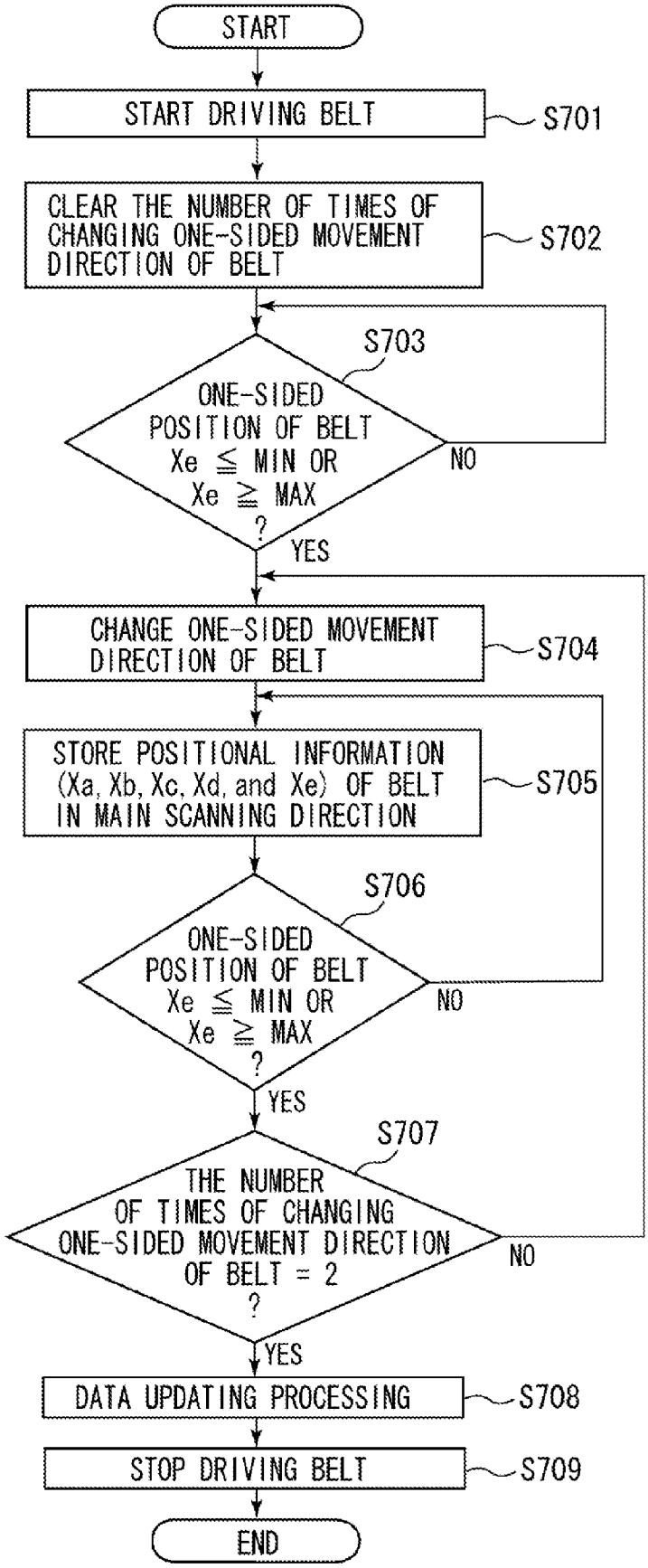
FIG. 7 is a flowchart illustrating processing for updating information in a storage unit during calibration.

FIG. 7 illustrates a calibration flow of an adjustment operation during a period when no image is formed, for example, when a product is shipped or after the apparatus has been used for a while. When image formation is started, in step S701, the driving roller 63 drives the intermediate transfer belt 61. In step S702, the number of one-sided travel adjustments stored in the memory 21 is cleared to 0.

The number of one-sided travel switching is counted each time the position of the one-sided movement correction roller 62 is switched between the two positions. The count value is stored in the memory 21. Then, the history of the main-scanning-direction position of the belt is stored starting from the first one-sided belt travel switching in steps S703 and S704. The history up to just before the third one-sided belt travel switching is stored in steps S705 to S707 and the data is updated. In step S708, driving of the belt is stopped and at the same time, in step S709, calibration is terminated. After the above operation, the history of the main-scanning-direction position of the belt corresponding to one period is stored in the memory 24.

FIG. 8 illustrates data stored in the memory 24. If the sampling is performed n times with respect to one period of the one-sided to-and-fro movement of the intermediate transfer belt, and the history of the main-scanning-direction position of the belt corresponding to one period of the to-and-fro movement is obtained and stored using the position detecting unit 9*a*, data Xa (1, 1) to Xa (1, n) are stored in the memory 24.

Further, the data Xa (1, 1) to Xa (1, n) are stored as average value data in data updating processing. In this case, the memory 24 does not include storage areas for second to m-th operations. Further, if the number of one-sided travel switching in step S707 of FIG. 7 is set to 2m, and an average value of the history of the main-scanning-direction position of the belt corresponding to a plurality of periods instead of one period is used, more stable control is possible.

Figure 9:
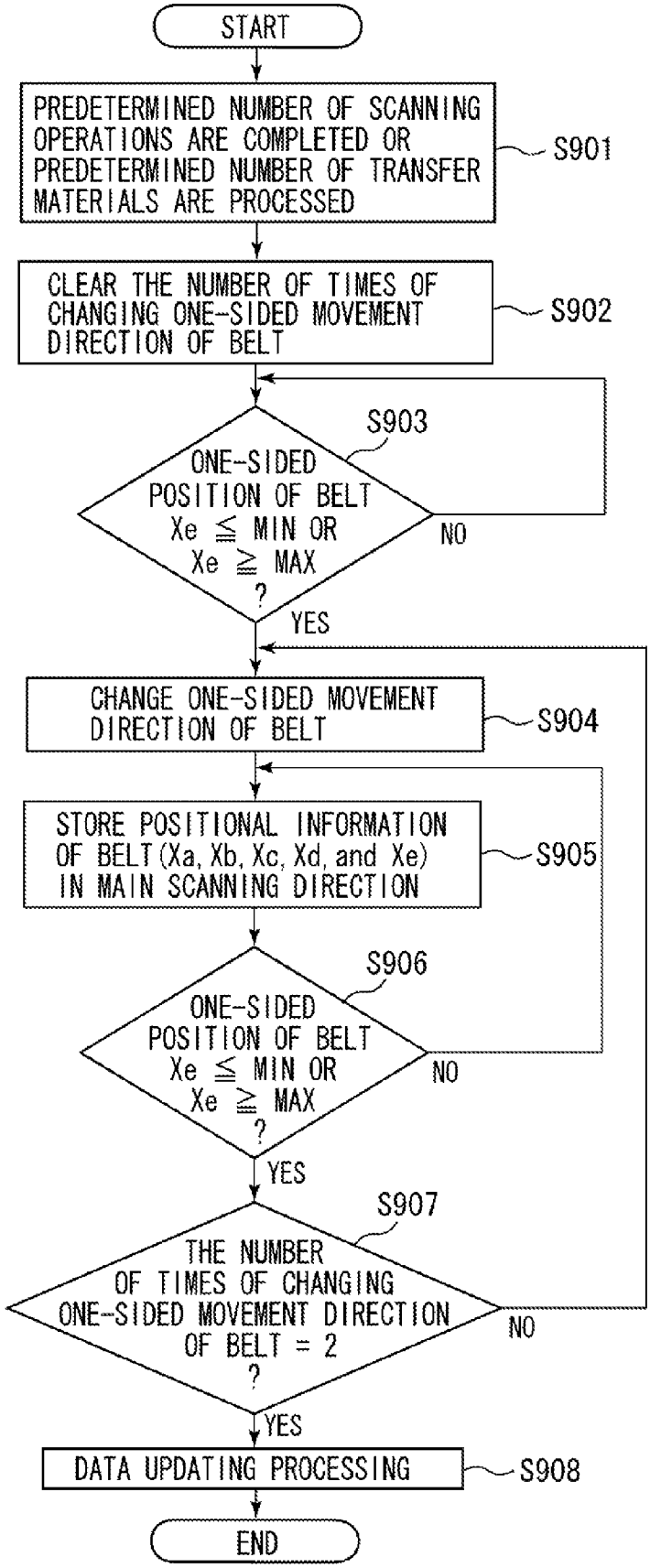
FIG. 9 is a flowchart illustrating processing for updating position history of a belt in a main scanning direction during exposure-scanning and adjusting a scanning timing.

On the other hand, the main-scanning-direction position of the belt varies depending on aged deterioration of the intermediate transfer belt 61 or belt driving system or a change of print conditions. Accordingly, it is necessary to update the history of the main-scanning-direction position of the belt as needed. FIG. 9 is a flowchart illustrating an operation for successively updating and storing the history of the main-scanning-direction position of the belt in the memory 24 during the operation of the image forming apparatus while adjusting a scanning timing and deleting data unnecessary for calculating a reference value from the data stored in the memory 24.

If conditions for starting this flow are satisfied in step S901, the number of one-sided travel switching stored in the memory 21 is cleared to 0 in step S902. The number of one-sided travel switching is counted each time the position of the one-sided movement correction roller 62 is switched between the two positions. The number of switching is stored in the memory 21.

Then, the history of the main-scanning-direction position of the belt is rewritten from the first one-sided belt travel switching to the memory 24 in steps S903 and S904, and the history up to just before the third one-sided belt travel switching is stored in steps S905 to S907. Further, if the number of one-sided travel switching in step S907 is set to 2m, the history of the main-scanning-direction position of the belt corresponding to a plurality of periods can be stored.

In this case, the past data is used for adjusting a scanning timing until storing of all data and image scanning are completed. After the completion of scanning, data is updated in step S908 to obtain new average value data for the next image scanning. As described above, this flow is executed each time a predetermined number of scanning operations is performed by the optical scanning unit or each time a predetermined number of transfer materials is transferred.

Second Exemplary Embodiment

Figure 10:
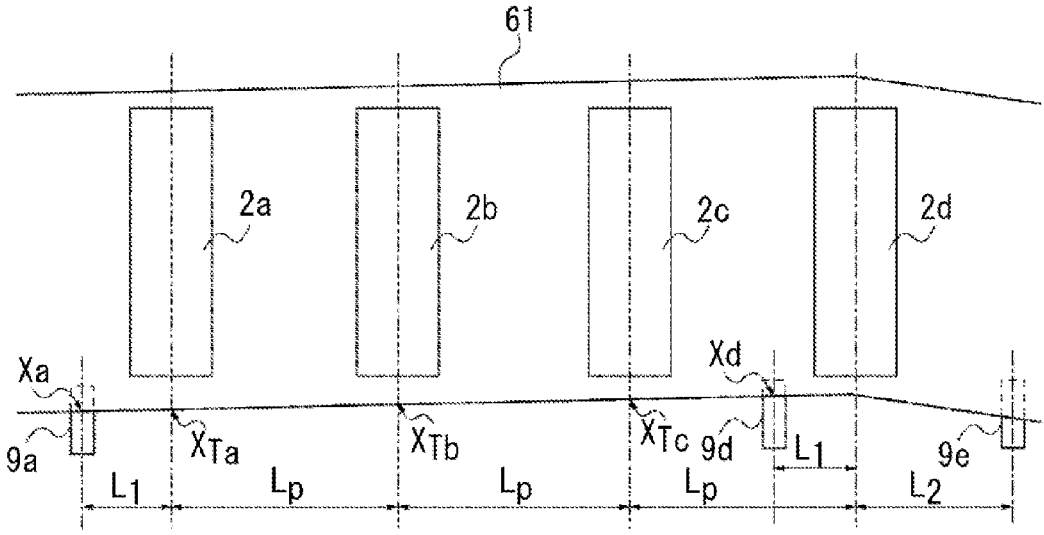
FIG. 10 is a top view illustrating each transfer position and its vicinities.

FIG. 10 is a top view illustrating each transfer position and its vicinities according to a second exemplary embodiment of the present invention. In FIG. 10, components having similar functions to the first exemplary embodiment are denoted by identical reference numerals, and components having similar configuration and functions are not described.

This exemplary embodiment differs from the first exemplary embodiment in that the sensors 9*b* and 9*c* are not provided on the assumption that if the belt is most tilted in a portion between the one-sided movement correction roller 62 that does not sandwich the belt and the transfer position (6*d*) closest to the correction roller 62, and a meandering motion of the belt between the driving roller 63 and the transfer position (6*d*) is approximated to the straight line, no practical problem occurs. A belt position in the transfer position (6*d*) is determined similar to the first exemplary embodiment.

Referring to FIGS. 10 and 4, the way to determine a position of one side edge of the belt in each transfer position is described below. When the apparatus starts an image forming process, the sensor 9*a* and the sensors 9*d* and 9*e* detect positions Xa, and Xd and Xe of one side edge of the intermediate transfer belt, respectively. An operation for calculating an approximate position $X_{Td}$ of one side edge of the belt is similar to the first exemplary embodiment and thus not described.

Then, the detected positions Xa and Xd of one side edge of the belt are compared with the position history charts LXa and LXd (see FIG. 4) to determine predicted positions Xa' and Xd' of one side edge of the intermediate transfer belt detected by the position detecting units 9*e* and 9*d* at the time of primary transfer. The determination result is output to the calculation unit 103. Next, the calculation unit 103 determines positions $X_{Ta}$, $X_{Tb}$, $X_{Tc}$ of one side edge of the belt at the primary transfer position in the primary transfer (the positions are geometrically determined on the assumption that the surface of the belt edge between the detection positions of the sensors 9*a* and 9*d* is linear) to output the determination result to the calculation unit 104.

$$X_{Ta} = \frac{L1 \cdot Xd' + (3 \cdot L_p - L1) \cdot Xa'}{3 \cdot L_p}$$

-continued $$X_{Tb} = \frac{(L1 + L_p) \cdot Xd' + (2 \cdot L_p - L1) \cdot Xa'}{3 \cdot L_p}$$

$$X_{Tc} = \frac{(L1 + 2 \cdot L_p) \cdot Xd' + (L_p - L1) \cdot Xa'}{3 \cdot L_p}$$

In this expression, $L_p$ represents a distance between adjacent transfer positions. According to this method, in practice, only the position history charts LXa, LXd, and LXe need to be stored in the memory 24 (storage unit), so that a storage capacity required of the memory 24 (storage unit) can be considerably reduced compared with the first exemplary embodiment. In the example, the operations for determining the main-scanning-direction approximate positions of the belt in each primary transfer position are collectively illustrated for ease of explanation.

In practice, however, position detecting processing and processing for determining the main-scanning-direction approximate positions of the belt at the next transfer position are carried out for each primary transfer position in order along the movement direction of the intermediate transfer belt 61. According to the result thereof, the optical scanning units 1*a* to 1*d* adjust a scanning start timing. In the exemplary embodiments of the present invention, a scanning start timing can be more accurately adjusted according to a change in main-scanning-direction position of the belt at each transfer position due to one-sided travel of the endless transfer belt serving as the intermediate transfer member or the transfer material conveying unit.

In the above two exemplary embodiments, the intermediate transfer belt 61 is an intermediate transfer member belt but may be a conveyor belt for directly conveying a transfer material to each transfer position. Further, while in the above exemplary embodiments, the driven roller 62 is a one-sided movement correction roller, if at least one of the rollers stretching the intermediate transfer belt 61 is a one-sided movement correction roller, the present invention is applicable.

Furthermore, if a change in main-scanning-direction position of the belt during the process time starting from the detection with the position detecting unit to the transfer is negligible, a scanning start timing may be determined based on the main-scanning-direction position of the belt at each transfer position at the time of detection in accordance with detection values of the first and second belt position detecting units.

Further, the present invention is applicable to the configuration in which a control target position of the endless type belt is determined in the main scanning direction and the belt position is restored to the target position each time the belt deviates from the target position. The present invention is also applicable to the configuration where ribs are provided to the edges of the endless type belt and the endless type belt is moved between the ribs in the main scanning direction.

In the above case, the storage unit and the calculation unit 103 can be omitted, and it is only necessary to determine a main-scanning-direction position of the belt with the calculation unit 102 at each transfer position at the time of detection. Further, the exemplary embodiments employ an inline type image forming apparatus (a method in which a plurality of photosensitive drums are arranged in line), but the present invention has an effect that an image can be transferred to a proper position even when a number of photosensitive drums (photosensitive member belt) is one and regardless whether the apparatus is a single-color type or a full-color type.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-126628 filed May 11, 2007, which is hereby incorporated by reference herein in its entirety.

What is claimed is:

1. An image forming apparatus, comprising:

an image carrier;

an optical scanning unit configured to scan the image carrier with light to form latent images;

a developing unit configured to develop latent images formed by the optical scanning unit into toner images;

an endless transfer belt onto which the toner images formed on the image carrier are transferred at a predetermined transfer position;

a first position detecting unit configured to detect a main-scanning-direction position of the endless transfer belt at a first position downstream from the transfer position in a movement direction of the endless transfer belt;

a second position detecting unit configured to detect a main-scanning-direction position of the endless transfer belt at a second position upstream from the transfer position in a movement direction of the endless transfer belt, wherein the first position detecting unit and the second position detecting unit respectively detect main-scanning-direction positions of one edge of the endless transfer belt at the first position and the second position; and a control unit configured to determine a scanning start position at which the optical scanning unit starts scanning the image carrier in the main scanning direction based on a main-scanning-direction position of the endless transfer belt detected by the first position detecting unit, and a main-scanning-direction position of the endless transfer belt detected by the second position detecting unit, wherein the control unit includes:

a calculation unit configured to determine predicted positions of the one edge at the first position and the second position at the start of transfer based on the detected positions of the one edge at the first position and the second position; and an adjustment unit configured to adjust a scanning start timing to start scanning in the main-scanning-direction such that the scanning start position is changed from a scanning start reference position according to a displacement up to a crossing point between a line connecting a reference position of the one edge on a line corresponding to the transfer position and each of the predicted positions of the one edge at the first position and the second position, and a line corresponding to the transfer position.

2. The image forming apparatus according to claim 1, further comprising:

a displacement unit configured to periodically reciprocate the endless transfer belt in the main-scanning-direction, wherein the control unit further includes a storage unit configured to store main-scanning-direction displacement information of the endless transfer belt at the first position and the second position, which corresponds to at least one period, and the calculation unit determines the predicted positions based on the main-scanning-direction displacement information.

* * * * *